US006188773B1

(12) United States Patent
Murata et al.

(10) Patent No.: US 6,188,773 B1
(45) Date of Patent: Feb. 13, 2001

(54) WATERPROOF TYPE MICROPHONE

(75) Inventors: Takashi Murata, Yokohama; Hiroshi Akino, Sagamihara, both of (JP)

(73) Assignee: Kabushiki Kaisha Audio-Technica, Tokyo (JP)

( * ) Notice: Under 35 U.S.C. 154(b), the term of this patent shall be extended for 0 days.

(21) Appl. No.: 09/384,890

(22) Filed: Aug. 27, 1999

(30) Foreign Application Priority Data

Aug. 31, 1998 (JP) ..... 10-245830

(51) Int. Cl.[7] ..... H04R 25/00

(52) U.S. Cl. ..... 381/361; 381/355; 381/367; 128/201.19

(58) Field of Search ..... 381/355, 359, 381/360, 361, 362, 367, 369, 376, 391, 189, FOR 148, FOR 147; 128/201.19; 379/174, 430, 175; 181/149

(56) References Cited

U.S. PATENT DOCUMENTS 6,018,585 * 1/2000 Akino et al. ..... 381/355

FOREIGN PATENT DOCUMENTS

2064265 * 6/1981 (GB) ..... 381/FOR 148

* cited by examiner

*Primary Examiner*—Huyen Le
(74) *Attorney, Agent, or Firm*—Welsh & Katz, Ltd.

(57) ABSTRACT

In order to equalize the pressure between the interior of an unit accommodating chamber and the outside of a mike casing without reducing a waterproof performance and an acoustic characteristic, there is provided a waterproof type microphone, which includes a mike casing 11 provided with an unit accommodating chamber having a sound receiving opening portion 141; a mike unit accommodated in the unit accommodating chamber 14; and a waterproof membrane 19 airtightly mounted on the sound receiving opening portion 141; the waterproof microphone further including an venting hole 21 formed in the mike casing 11 to cause the unit accommodating chamber to be communicated with outside of the mike casing 11 and a pressure equalizing membrane 22 mounted on the venting hole 21.

16 Claims, 3 Drawing Sheets

WATERPROOF TYPE MICROPHONE

FIELD OF THE INVENTION

The present invention relates to a waterproof type microphone, and more specifically, to a waterproof type microphone which enables equivalent pressures between the interior of an unit accommodating chamber and the outside of a casing without impairment of the waterproof function.

BACKGROUND OF THE INVENTION

A headset type microphone is worn on the head of a user for a long period of time. For the reason, the headset microphone is different from a hand-held type microphone that it is often suffered from liquid such as sweat and spittle of the user. In addition, the headset microphone is often submerged in water of for example, swimming pool by sports instructors. As a result, such the liquid sometimes adversely affects the headset microphone.

Besides the headset microphone, for example, "Karaoke" (or orchestra) microphone is used in entertainment facilities where beverages such as beer and juice are served. For the reason, such the microphone is suffered from the beverage dashed thereon, and erroneous dropping thereof into the beverage.

Accordingly, as shown in FIG. 5, in a conventional accommodation of a mike unit 2 into an unit accommodating chamber 1*a* of a mike casing 1, a sound receiving opening portion 1*b* of the mike casing 1 is covered with a waterproof membrane 3, and an O-ring 5*a* is interposed between a support arm 4 of a headset and the mike casing 1 so that the unit accommodating chamber 1*a* is kept airtightly.

In this instance, the waterproof membrane 3 comprises a thinner plastic film made of materials such as polyethylene, and polyethylene terephtalate, which does not seriously affect vibration energy of sound wave passing therethrough so that excellent sensitivity, frequency characteristic and directivity are produced.

Furthermore, to provide an excellent acoustic characteristics, the waterproof membrane 3 is put on a support ring 3*a* in such a way not to be pulled by large tension applied thereto, and covers over a sound receiving opening portion 1*b* through the support ring 5*a*. In addition, an O-ring 5*b* is also provided between the support ring 3*a* and the mike casing 1.

However, the waterproof membrane 3 and the O-rings 5*a*, 5*b* seal the interior of the unit accommodating chamber 1*a* almost completely. So, the waterproof membrane 3 undergoes pressure differential between the interior of the unit accommodating chamber and the outside of the mike casing due to the changes in external atmospheric pressure and internal temperature and the like. consequently, the waterproof membrane 3 has a resonant point under tension. Theerefore, the acoustic characteristics become lessened. The possibility arises that the waterproof membrane 3 will be broken.

To prevent this, the internal volume of the unit accommodating chamber is increased. When the sound receiving portion cannot be formed in larger size, a bypass passage then brings the sound receiving portion into communication with a large volume portion which is separately formed within the mike casing, as proposed, for example, in Japanese Utility Model Publication No. 7-28793 Publication.

However, any of objectives of methods mentioned above is to maintain airtightness of the interior of the unit accommodating chamber. Therefore, basically, the problem of the pressure differential between the interior of the unit accommodating chamber and the outside of the mike casing is not solved. In order to solve the problem, it is contemplated to provide permeability for the waterproof membrane itself. However, an acoustically desirable material is even yet not found such the waterproof membrane.

Such the problem will be accomplished by the present invention. Accordingly, an object of the invention is to provide a waterproof type microphone which equalizes the pressures between the interior of an unit receiving chamber and the outside of a mike casing without degradation of the waterproof performance and acoustic characteristics.

SUMMARY OF THE INVENTION

For the achievement of the object described above, the present invention provides a waterproof type microphone including a mike casing disposed in an unit accommodating chamber having a sound receiving opening; the unit accommodating chamber having a mike unit accommodated therein, and a membrane mounted on said sound receiving opening, wherein said mike casing has a venting hole which brings said unit accommodating chamber into communication with the outside of the mike casing, and a water non-permeability membrane mounted on the venting hole thereof.

According to the above-mentioned arrangement, since the interior of the mike casing is connected with the outside thereof through the venting hole, no pressure differential between inside and outside occurs. Therefore, the waterproof membrane is not pulled by high tension to excess. Further, since the venting hole has a water non-permeability venting membrane mounted thereon, the mike casing is not susceptible to the entry of liquids from the outside thereof.

In the present invention, a support ring for supporting said waterproof membrane has an internal peripheral edge formed on the side of a waterproof membrane supporting face, and preferably the internal peripheral edge has a protective surface with a predetermined inclined angle or a predetermined curvature. Thereby, the waterproof membrane will be avoided from breakage thereof.

Furthermore, preferably, the waterproof membrane is supported on the support ring by an adhesive material which exhibits viscosity (elasticity) even after setting. Thereby, even though the waterproof membrane is pulled out by tension, the adhesive material with the viscosity will damp the tension.

The present invention also includes a waterproof membrane having a resonance preventing portion which is formed by fine rugged notches thereon.

DETAILED DESCRIPTION OF THE INVENTION

Figure 1:
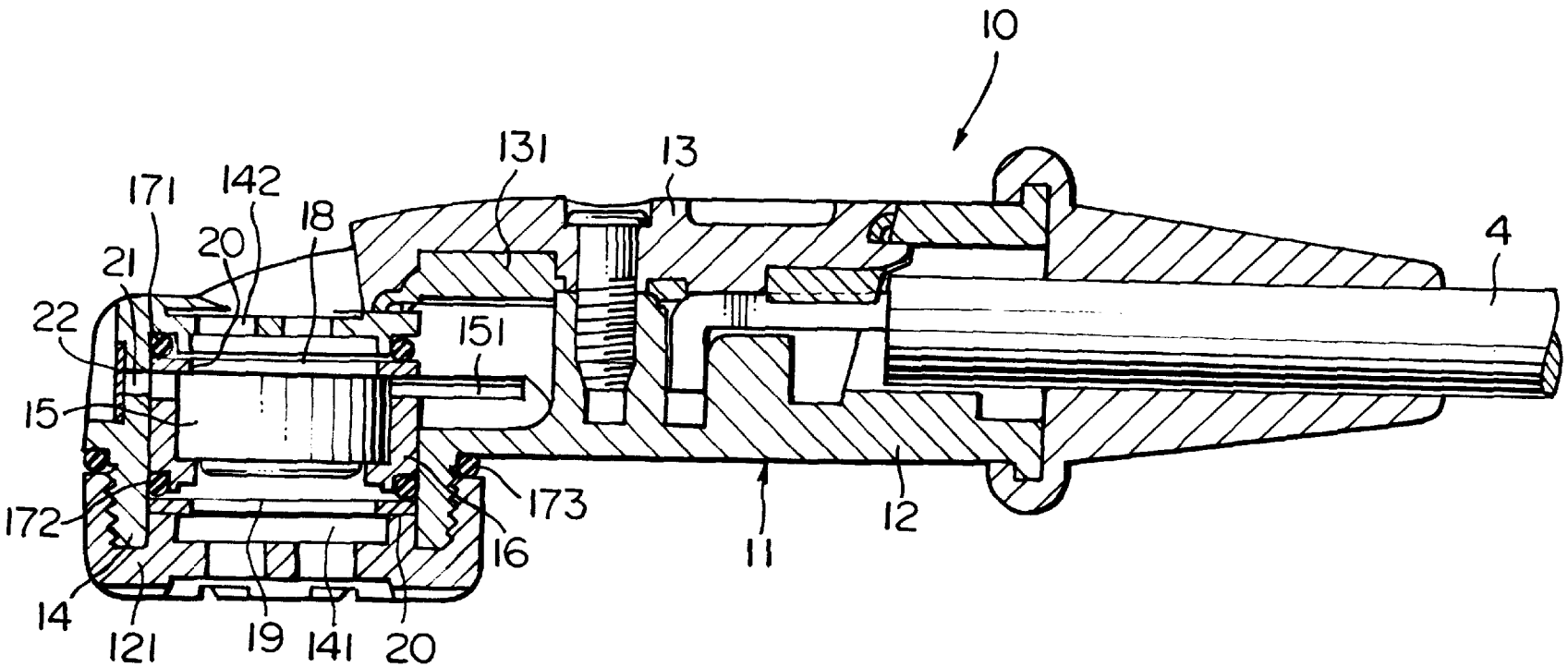
FIG. 1 is a sectional view showing a waterproof type microphone according to one embodiment of the present invention.

The present invention will be described in detail hereinafter with reference to embodiments shown in the drawings.

Figure 2:
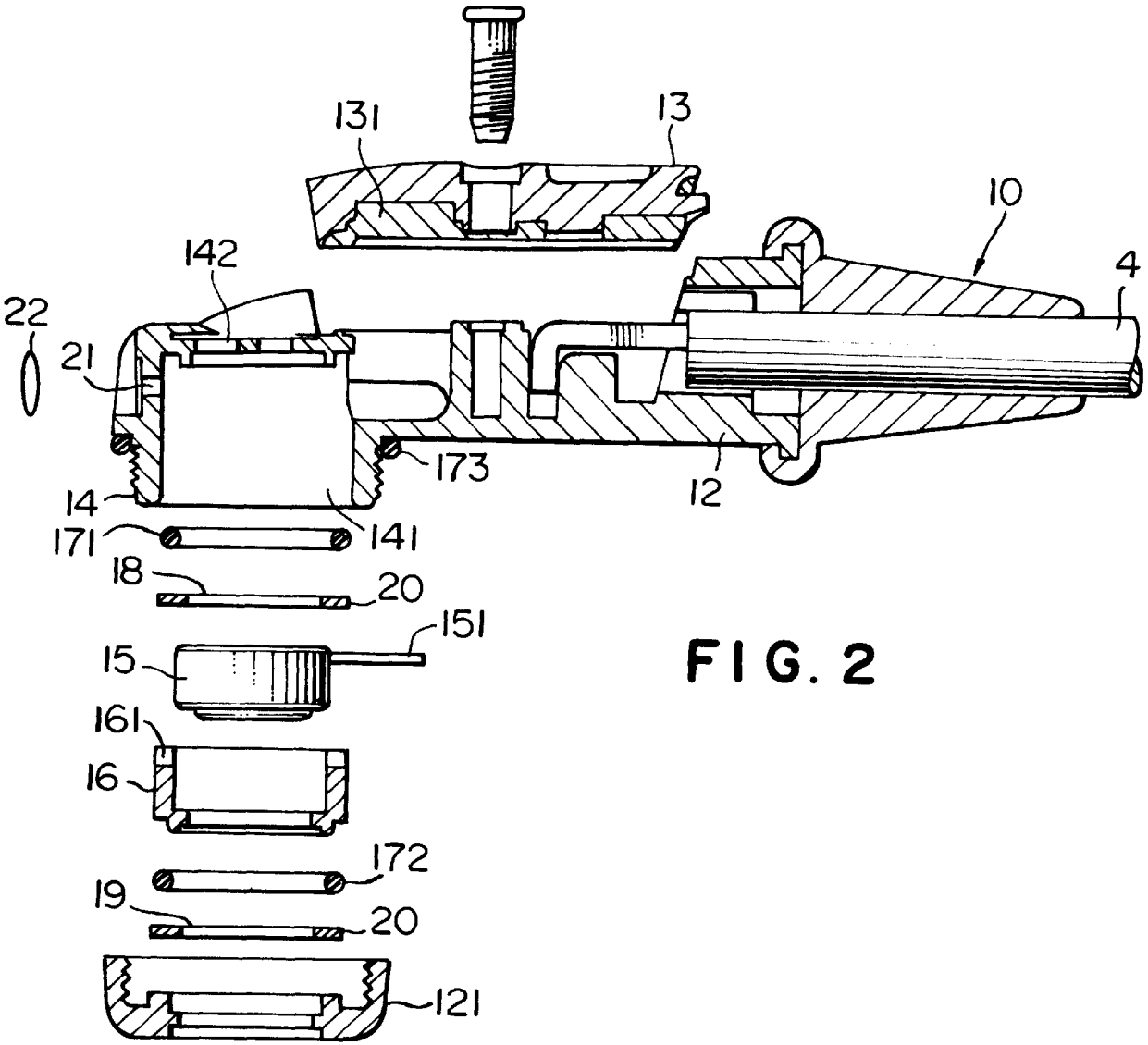
FIG. 2 is an exploded assembly view of the above-mentioned embodiment.

Referring to FIG. 1 (a sectional view) and FIG. 2 (an exploded assembly view), a waterproof type microphone 10 according to this embodiment is for a headset and comprises a mike casing 11 mounted on a support arm 4 of the headset.

In this embodiment, the mike casing 11 comprises a casing body 12 mounted on the end of the support arm 4, and a casing cover 13 secured to the back side (the upper surface side in FIG. 2) of the casing body 12 by a fastening screw. The casing cover 13 is detachably secured to the back side of the casing body 12 so as to facilitate the wiring works in the casing body 12, and the casing cover 13 has a seal member 131 such as rubber mounted on the inner surface thereof.

The casing cover 13 has an unit accommodating portion disposed at end thereof and formed in a cylindrical shape. The unit accommodating portion 4 has openings, of which one end forms a front sound receiving opening portion 141, which is directed to the mouth of a speaker, and the front sound receiving opening portion 141 has a case ring 121 which fit therewith. The case ring 121 forms a portion of the case body 12.

According to this embodiment, there is also a rear sound receiving opening portion 142 formed at the other end of the unit accommodating portion 14. The front sound receiving opening portion 141 and the rear sound receiving opening portion 142 have a water repellent mesh, respectively, but not shown.

The unit accommodating portion 14 accommodates a mike unit 15 therein. In this case, the mike unit 15 is of a single directive unit. For this reason, the unit accommodating portion 14 is provided with the rear sound receiving opening portion 142 in addition to the front sound receiving opening portion 141 as described above.

The mike unit 15 is covered with a tubular spacer 16 made of synthetic resin, and held in a predetermined position in the unit accommodating portion 14 thorough the tubular spacer 16 Furthermore, the mike unit 15 has a circuit substrate 151 mounted therein for collecting electrical signals from the mike unit 15.

There are an O-ring 171 and a waterproof membrane 18 disposed on the back surface side of the mike unit 15, where is on the side of the rear sound receiving opening portion 142 of the unit accommodating portion 14. There are also an O-ring 172 and a waterproof membrane 19 disposed on the front surface side of the mike unit 15, where is on the side of the front sound receiving opening portion 141 of the unit accommodating portion 14. Further, in this embodiment, an O-ring 173 is also interposed between the casing ring 121 and the case body 12 about the outer peripheral surface of the unit accommodating portion 14.

A side wall of the unit accommodating portion 14 has a venting hole 21 bored therein, and the venting hole 21 brings the interior of the unit accommodating portion 14 into communication with the outside of the mike casing, and the venting hole 21 is provided with an pressure equalizing membrane 22. The pressure equalizing membrane 22 may be mounted at either of the inside or outside of the unit accommodating portion 14.

The pressure equalizing membrane 22 to be used comprises a water non-permeability membrane. At this time, this kind of the water non-permeability membranes are produced by various makers. In this embodiment, Microtex NTF1026-CO2 manufactured by NITTO DENKO-SHA or products with a performance similar to Microtecx is used.

In this embodiment, the tubular spacer 16 is also provided with a venting hole 161 corresponding to the venting hole 21, since the mike unit 15 is covered with the tubular spacer 16.

As described above, according to the present invention, even though pressure variation is caused by outside air, the pressure differential between the outside of the mike casing and inside of the unit accommodating portion 14 is almost reduced, since the venting hole 21 is bored in the side wall of the unit accommodating portion 14 to allow the interior of the unit accommodating portion 14 to be communicated with outside of the unit accommodating portion 14.

Moreover, the waterproof performance is not reduced, since the pressure equalizing membrane 22 of the water non-permeability membrane is mounted on the venting hole 21. Therefore, the waterproof membranes 18 and 19 are allowed to be mounted by the stable tension applied thereto so that excellent waterproof performance and excellent acoustic characteristics are maintained.

Furthermore, though not shown in detail, the outer surface of the tubular spacer 16 is plated by metal, and a part of the metal plate is connected with an earth line of a circuit substrate 151. In this manner, the tubular spacer 16 can be used also as an electromagnetic seal for the mike unit 15.

The waterproof membranes 18 and 19 are formed out of an extremely thin (for example, 4 $\mu$m thickness) plastic film, for example, such as polyethylene, polyethylene terephtalate, etc., both of which are supported by the support rings 20, 20.

Figure 3:
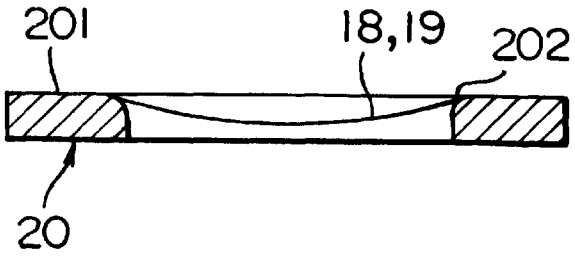
FIG. 3 is a sectional view showing a support ring of a waterproof membrane according to the above-mentioned embodiment.

Since the both support rings 20, 20 have same construction, one of the support rings 20 will be described with reference to FIG. 3. The support ring 20 is made of, for example, phosphorbronze or metal such as stainless, of which one surface is provided with waterproof membranes 18 and 19 mounted thereon through an adhesive not shown. A water proof supporting surface 201 has an inner peripheral edge provided with a convex curved surface 202 to the side of a waterproof membrane support surface thereof.

Figure 4:
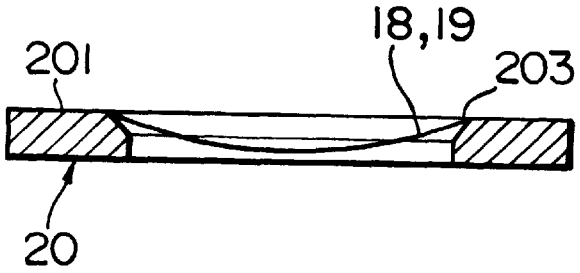
FIG. 4 is a sectional view showing a modified form of the waterproof membrane support ring.
Figure 5:
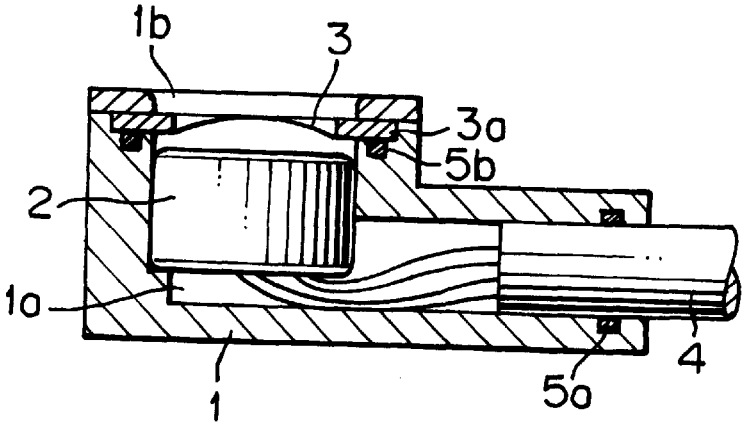
FIG. 5 PRIOR ART
FIG. 5 is a sectional view schematically showing a conventional waterproof type microphone.

The convex curved surface 202 comprises a surface for protecting the waterproof membranes 18 and 19. Therefore, for example, even if the waterproof membranes 18, 19 are, as indicated by the chain line, pulled inwardly of the support ring 20 by the tension caused by the outer pressure, the waterproof membranes 18, 19 are cut from the edge portion. The protective surface may be formed by a tapered surface 203 having a predetermined inclination angle as shown in FIG. 4.

While the waterproof membranes 18 and 19 are loosely mounted on the support ring by almost no tension through an adhesive. In this embodiment, an adhesive with adequate viscosity (elasticity) after setting, such as a silicon rubber adhesive or a 2-liquid epoxy adhesive is used, which has low hardness after setting.

According to the arrangement described above, when the waterproof membranes 18, 19 are pulled by the tension of external pressure or the like, the waterproof membranes 18, 19 are effectively prevented from the excessive tension because of the damping tension caused by the viscosity of the adhesive.

Furthermore, though not shown in detail, the waterproof membranes 18, 19 has a fine rugged portions formed by the grain transfer processing, for example so that the resonance of the waterproof membranes 18, 19 can be reduced.

In the embodiment described above, the rear sound receiving opening portion 142 is also disposed on the back side of the unit accommodating portion 14 because of the unidirectional mike unit. However, if the mike unit 15 has a non-directional performance, there is no need for providing the rear sound receiving opening portion 142, and accordingly, the O-ring 171 and the waterproof membrane 18 are also may not be mounted on the back side of the unit accommodating portion 14.

Furthermore, in the above-mentioned embodiment, although the descriptions were given with respect to only the waterproof type microphone for headset, it should be observed that the present invention is not limited to the water proof type microphone for headset, and, other waterproof type microphones are off course can be applied.

As described above, according to the present invention, the mike casing is provided with the venting hole which brings the unit accommodating chamber into communication without side of the casing, the venting hole is provided with the water non-permeability membrane as the pressure equalizing membrane, and thereby equal pressure is provided between the interior of the unit accommodating chamber and the outside of the mike casing.

Furthermore, the waterproof membrane is effectively prevented from the breakage caused by the tension applied thereon, since the support ring has a protective surface formed at the inner peripheral edge to the side of the waterproof membrane, the protective surface having a predetermined inclination angle or a predetermined curvature.

Moreover, when the waterproof membrane is mounted on the support ring, the adhesive with viscosity after setting is used. Even though the waterproof membrane is pulled by tension applied thereto, the viscosity of the adhesive damps the tension. Thereby, the waterproof membrane is prevented from the breakage thereof caused by the tension applied thereto.

Moreover, the resonance of a single membrane is suppressed, since the waterproof membrane has the fine rugged notches.

Therefore, excellent acoustic characteristics can be maintained.

What is claimed is:

1. A waterproof type microphone including a mike casing provided with a unit accommodating chamber having a sound receiving opening portion, said unit accommodating chamber having an interior, exterior and side surface, a mike unit accommodated in said unit accommodating chamber, and a waterproof membrane airtightly mounted on said sound receiving opening portion, the waterproof microphone further including a first venting opening formed in a side wall of the unit accommodating chamber, said venting opening bringing said unit accommodating chamber into communication with the outside of the mike casing, and a water non-permeability venting membrane provided to said first venting opening.

2. The waterproof type microphone according to claim 1, the waterproof type microphone further including a support ring for supporting said waterproof membrane, the support ring having an inner peripheral edge to the side of the portion on which said waterproof membrane is supported, the inner peripheral edge having a predetermined inclination or a predetermined curvature.

3. The waterproof type microphone according to claim 1, the waterproof type microphone further including a support ring for supporting said waterproof membrane, the waterproof membrane being supported on the support ring by an adhesion means having viscosity even after setting.

4. The waterproof type microphone according to claim 1, wherein said waterproof membrane includes fine rugged notches formed thereon as resonance preventing means.

5. A waterproof type microphone including a microphone unit, a casing having a unit accommodating chamber for accommodating said microphone unit, front and back sound receiving opening portions disposed at front and back surfaces of said unit accommodating portion, respectively, a microphone unit disposed within the hollow interior of said casing, waterproof membranes airtightly disposed at said front and back sound receiving opening portions, respectively, said waterproof type microphone including a first vent opening formed at a side wall of the unit accommodating chamber of said casing so as to permit communication between an exterior and an interior of the unit accommodating chamber, and water non-permeable vent membrane provided at said first vent opening inside or outside of said unit accommodating unit.

6. A waterproof type microphone according to claim 5, wherein said waterproof microphone includes a tubular case for covering said microphone unit, and a second vent opening formed from the side wall of said unit accommodating chamber extending to said tubular case and corresponding to said first vent opening.

7. A waterproof type microphone including a microphone unit having a front acoustic terminal and a rear acoustic terminal, a tubular case for covering said microphone unit, a casing having a unit accommodating chamber for accommodating said tubular case and a front opening for receiving sound, waterproof membranes or films for covering in said casing the front and rear acoustic terminals of said microphone unit, respectively, stainless meshes disposed between said waterproof membranes or films and the front and rear acoustic terminals of said microphone unit, said waterproof-type microphone including a venting opening formed at a side wall of the unit accommodating chamber of said casing, a second vent opening formed at a side wall of said tubular case and corresponding to said first vent opening so that exterior of the unit accommodating portion is brought into communication with interior of the unit accommodating chamber, and water non-permeable vent membrane provided at said first vent opening bringing the exterior of the unit accommodating chamber into connection with the interior of the unit accommodating chamber, and the water non-permeable vent membrane provided at said vent opening inside or outside of said unit accommodating chamber.

8. A waterproof type microphone comprising of a microphone unit having a circuit board, a tubular case for covering said microphone unit, a casing having a front surface, a rear surface, a unit accommodating chamber between said front and rear surfaces for accommodating said microphone unit, a front sound receiving opening portion bored in said front surface, and a rear sound receiving opening portion partially bored in said rear surface, the casing having a small diameter portion extending from substantially an intermediate portion, a lid for casing mounted on said front surface for covering said front surface, said microphone unit, and an outer peripheral surface of the small diameter portion of said casing, first and second waterproof membrane member each having a support ring and a waterproof membrane supported by said support ring thereon, the first waterproof membrane member being mounted between said tubular case and said lid for casing, the second waterproof membrane member being mounted between a back face of said microphone and the rear surface of said casing, a first O ring mounted between a front surface of said tubular case and said first waterproof membrane member, a second O ring mounted between the rear surface of said casing and said second waterproof membrane member, a third O shaped ring mounted between the substantially intermediate portion of said casing and a back surface of said lid for casing, a first vent opening bored in the side surface of the unit accommodating chamber of said casing, a second vent opening bored in a side surface of said tubular casing, and water non-permeable vent membrane provided at said first vent opening interior or exterior of said unit accommodating chamber, whereby exterior of the unit accommodating chamber is brought into communication with interior of the unit accommodating chamber.

9. The waterproof type microphone according to claim 8, wherein said first and second waterproof membrane member includes said support ring having an inner peripheral edge on which said waterproof membrane is adhered, the inner peripheral edge having a predetermined inclination or curvature.

10. The waterproof type microphone according to claim 9, wherein the respective waterproof membranes of said first and second waterproof membrane members are adhered to the support ring by adhesion having viscosity even after setting.

11. The waterproof type microphone according to claim 9, wherein said waterproof membrane having fine rugged notches formed thereon as resonance preventing means.

12. The waterproof type microphone according to claim 8, wherein the respective waterproof membranes of said first and second waterproof membrane members are adhered to the support ring by adhesion having viscosity even after setting.

13. The waterproof type microphone according to claim 8, wherein said waterproof membrane having fine rugged notches formed thereon as resonance preventing means.

14. The waterproof type microphone according to claim 8, wherein the respective waterproof membranes of said first and second waterproof membrane members are comprised of a plastic film thereby having no small loss in vibrating energy.

15. The waterproof type microphone according to claim 8, wherein said tubular case having a metal platted outer surface, said metal platted outer surface connecting to a circuit substrate thereby having said outer metal plated surface of said tubular case acting as an electromagnetic seal.

16. The waterproof type microphone according to claim 8, wherein the support rings are further comprised of a phosphor bronze or stainless metal.

* * * * *